US010088131B2

(12) United States Patent
Su et al.

(10) Patent No.: US 10,088,131 B2
(45) Date of Patent: Oct. 2, 2018

(54) BACKLIT DISPLAY ASSEMBLY

(71) Applicants: Lu Su, Paramus, NJ (US); Samuel Yuehli Su, Alpine, NJ (US)

(72) Inventors: Lu Su, Paramus, NJ (US); Samuel Yuehli Su, Alpine, NJ (US)

( * ) Notice: Subject to any disclaimer, the term of this patent is extended or adjusted under 35 U.S.C. 154(b) by 0 days.

(21) Appl. No.: 15/954,315

(22) Filed: Apr. 16, 2018

(65) Prior Publication Data

US 2018/0231217 A1 Aug. 16, 2018

Related U.S. Application Data

(63) Continuation of application No. 15/439,478, filed on Feb. 22, 2017, now Pat. No. 9,945,539.

(60) Provisional application No. 62/410,127, filed on Oct. 19, 2016.

(51) Int. Cl.

| | |
|---|---|
| ***G09F 13/26*** | (2006.01) |
| ***F21V 17/00*** | (2006.01) |
| ***F21V 11/00*** | (2015.01) |
| ***G09F 13/22*** | (2006.01) |
| ***G09F 13/00*** | (2006.01) |
| ***G09F 13/04*** | (2006.01) |
| ***A47G 1/06*** | (2006.01) |
| ***F21V 23/04*** | (2006.01) |
| ***F21V 23/00*** | (2015.01) |
| *F21Y 115/10* | (2016.01) |

(52) U.S. Cl.

CPC ..... *F21V 17/002* (2013.01); *A47G 1/06* (2013.01); *F21V 11/00* (2013.01); *F21V 23/001* (2013.01); *F21V 23/0435* (2013.01); *G09F 13/005* (2013.01); *G09F 13/04* (2013.01); *G09F 13/22* (2013.01); *F21Y 2115/10* (2016.08)

(58) Field of Classification Search

CPC ..... G09F 13/26; G09F 13/04; G09F 13/08; G09F 13/10

USPC ..... 40/431, 443, 577

See application file for complete search history.

(56) References Cited

U.S. PATENT DOCUMENTS

| | | | | |
|---|---|---|---|---|
| 2,565,553 A * | 8/1951 | Foley | G09F 13/10 | 40/577 |
| 3,666,936 A * | 5/1972 | Webster, Jr. | G09F 13/10 | 362/812 |
| 3,997,991 A * | 12/1976 | Hayman-Chaffey | G09F 13/10 | 40/361 |
| 4,368,587 A * | 1/1983 | Childs | G03F 3/02 | 101/150 |

(Continued)

*Primary Examiner* — Gary C Hoge

(74) *Attorney, Agent, or Firm* — Nelson Mullins Riley & Scarborough LLP

(57) ABSTRACT

A display assembly having a first backlit display including a first panel with a first color image formed thereon, the first color image including a first transparent portion of a first color and a second transparent portion of a second color, a second panel including a first transparent portion of a first color and an opaque portion so that light from the light source does not pass through a corresponding portion of the first panel, and a light source that emits at least a first color light and a second color light, wherein the first color of the first transparent portion of the first panel is a different color than the first color of the first transparent portion of the second panel, and light from the light source passes through the first transparent portions of both the first panel and the second panel.

2 Claims, 14 Drawing Sheets

(56) References Cited

U.S. PATENT DOCUMENTS

| | | | | |
|---|---|---|---|---|
| 8,479,427 | B2 * | 7/2013 | Verheye | A47G 1/0622<br>40/577 |
| 2004/0177540 | A1 * | 9/2004 | Abron | G09F 13/04<br>40/577 |
| 2008/0115395 | A1 * | 5/2008 | Saito | G08B 7/062<br>40/564 |
| 2012/0294010 | A1 * | 11/2012 | Slaughter | A47C 21/003<br>362/307 |
| 2013/0258678 | A1 * | 10/2013 | Nichols | F21V 11/16<br>362/351 |

* cited by examiner

| Back light color | Masking element on 2nd piece of film | Element on 1st piece of film | Color observer sees |
|---|---|---|---|
| White | Blue* | Green* | Light Blue |
| White | Blue* | Red* | Purple |
| White | Blue* | Yellow* | Lime Green |
| Red | Blue* | Green* | Dark Green |
| Red | Blue* | Red* | Magenta |
| Red | Blue* | Yellow* | Cream |
| Green | Blue* | Green* | Bright Green |
| Green | Blue* | Red* | Burgundy |
| Green | Blue* | Yellow* | Beige |
| Blue | Blue* | Green* | Navy Blue |
| Blue | Blue* | Red* | Violet |
| Blue | Blue* | Yellow* | Canary Yellow |
| White | Green* | Blue* | Light Blue |
| White | Red* | Blue* | Berry |
| White | Yellow* | Blue* | Greenish Blue |
| Red | Green* | Blue* | Navy Blue |
| Red | Red* | Blue* | Magenta |
| Red | Yellow* | Blue* | Dark Blue |
| Green | Green* | Blue* | Greenish Blue |
| Green | Red* | Blue* | Burgundy |
| Green | Yellow* | Blue* | Light Blue |
| Blue | Green* | Blue* | Navy Blue |
| Blue | Red* | Blue* | Purplish Blue |
| Blue | Yellow | Blue* | Yellowish Blue |
| White, Red, Green, or Blue | Black (K=100%) | Green* | Green |
| White, Red, Green, or Blue | Black (K=100%) | Red* | Red |
| White, Red, Green, or Blue | Black (K=100%) | Yellow* | Yellow |
| No back light | Clear | Green* | Green (same green as above) |
| No back light | Clear | Red* | Red (same red as above) |
| No backlight | Clear | Yellow* | Yellow (same yellow as above) |
| White | Black (K= 10%) | Green* | Green (darker |
| White | Black (K=10%) | Red* | Red (darker hue) |
| White | Black (K=l0%) | Yellow* | Yellow (darker hue) |

*

- Blue: C=27%, M=0%, Y=3%, K=0%
- Yellow: C=1%, M=0%, Y=32%, K=0%
- Green: C=25%, M=0%, Y=38%, K=0%
- Red: C=1%, M=35%, Y=14%, K=0%

Fig. 10

BACKLIT DISPLAY ASSEMBLY

CLAIM OF PRIORITY

The present application is a continuation of U.S. patent application Ser. No. 15/439,478, filed Feb. 22, 2017, now U.S. Pat. No. 9,945,539, which claims priority to U.S. Provisional Patent Application No. 62/410,127, filed Oct. 19, 2016, the entire disclosure of each of which is incorporated by reference herein.

FIELD OF INVENTION

The present invention relates generally to display assemblies for art, advertising, etc., and more specifically to display assemblies that are backlit to enhance viewing of the displayed image.

BACKGROUND

The present invention recognizes and addresses considerations of prior art constructions and methods.

SUMMARY

One embodiment in accordance with the present disclosure is a display assembly having a first backlist display including a first panel with a first color image formed thereon, the first color image including a first transparent portion of a first color and a second transparent portion of a second color that differs from the first color of the first transparent portion of the first panel, a second panel including a first transparent portion of a first color and an opaque portion so that light from the light source does not pass through a corresponding portion of the first panel, the second panel being adjacent to the first panel such that the first transparent portion of the first panel is aligned with the first transparent portion of the second panel, and a light source that emits at least a first color light and a second color light. The first color of the first transparent portion of the first panel is a different color than the first color of the first transparent portion of the second panel and light from the light source passes through the first transparent portion of both the first panel and the second panel.

Another embodiment in accordance with the present disclosure is a display assembly having a first backlit display including a first panel with a first color image formed thereon, the first color image including a first transparent portion of a first color, a second panel including a first transparent portion of a first color, a second transparent portion of a second color, and an opaque portion so that light from the light source does not pass through a corresponding portion of the first color image of the first panel, the second panel being aligned with the first panel such that the first transparent portion of the first panel is aligned with the first transparent portion of the second panel, a third panel including a second color image thereon, the second color image including a first transparent portion of a first color, the third panel being aligned with the second panel such that the second transparent portion of the second panel is aligned with the first transparent portion of the third panel, wherein the third panel and the second panel abut each other along adjacent surfaces so that the third panel is both parallel to and spaced part from the first panel, and a light source that includes at least a red light emitting diode, a green light emitting diode, and blue light emitting diode, wherein the first color of the first transparent portion of the first panel is a different color than the first color of the first transparent portion of the second panel, and light from the light source passes through the first transparent portions of the first panel, the second panel and the third panel.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which:

FIG. 10 is a chart showing various color combinations that are visible to an observer of the backlit art display shown in FIG. 1;

Figure 1:
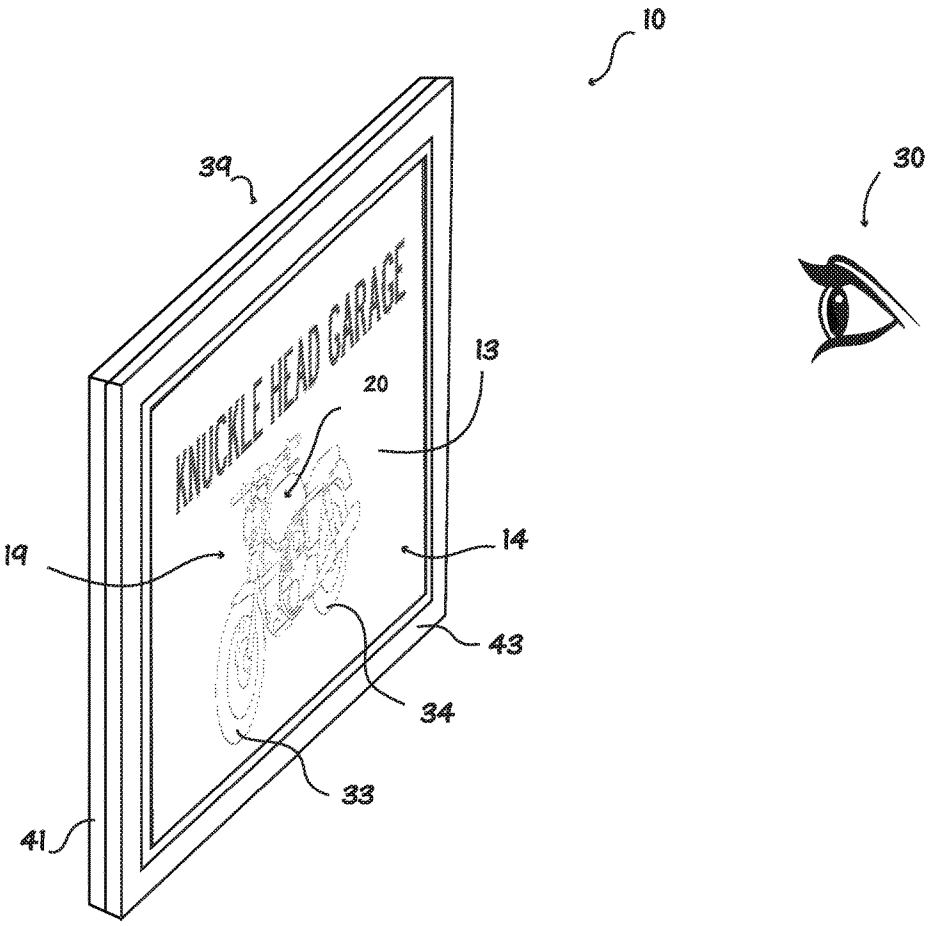
FIG. 1 is a perspective view of a backlit display assembly in accordance with an embodiment of the present disclosure.

Repeat use of reference characters in the present specification and drawings is intended to represent same or analogous features or elements of the invention according to the disclosure.

DETAILED DESCRIPTION

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
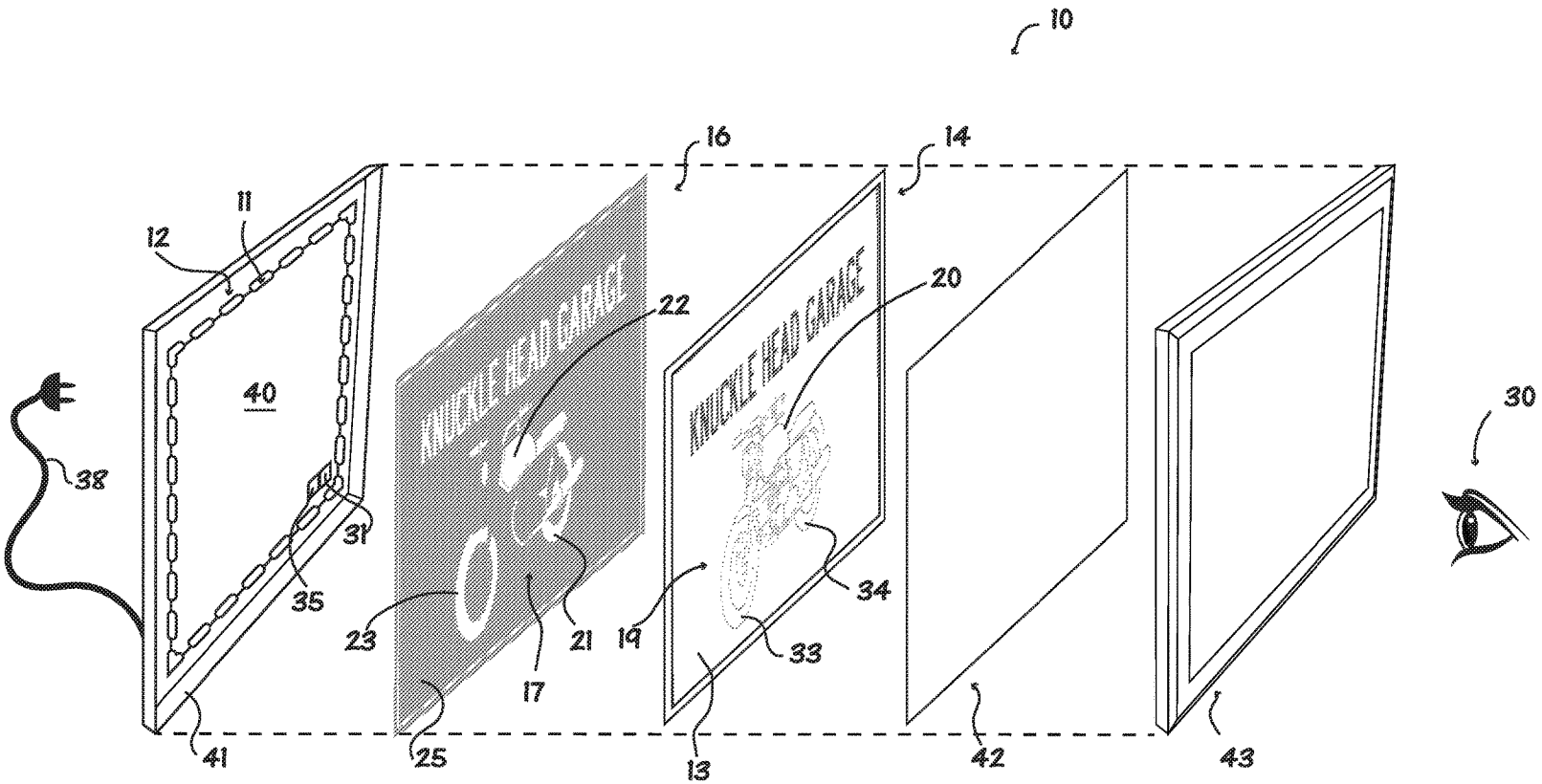
FIG. 2 is an exploded, perspective view of the backlit display assembly shown in FIG. 1.

Referring now to FIGS. 1 and 2, a backlit display assembly 10 in accordance with the present disclosure is shown. Display assembly 10 allows for selected elements in a sign, image or work of art to change to different colors or different shades/levels of intensity of the same color. Backlit display 10 includes an outer panel 14, an inner panel 16, and a light source 12 that are received within a frame 39, or housing, which includes a front frame portion 43 and a rear frame portion 41. Display assembly 10 may also include a rear panel 40 and a protective, see-through front panel 42 as components of frame 39. As shown, rear panel 40 is rigidly secured to rear frame portion 41. In the embodiment shown, outer panel 14 and inner panel 16 are dispersed within frame 39 in close registration to each other, i.e., they are preferably in contact with each other along their adjacent surfaces. However, as discussed in greater detail below, there may also be slight separation between the panels of the display in alternate embodiments. Preferably, front frame portion 43 and rear frame portion 41 are selectably securable to each other so that various other images on different outer and inner panels 14 and 16 may be displayed. As well, although light source 12 is preferably disposed within display assembly 10 as shown in FIG. 2, in alternate embodiments light source 12 can be external to display assembly 10. When light source 12 is external to display assembly 10, rear panel 40 must be either transparent or translucent so that light is allowed to pass through outer and inner panels 14 and 16, as discussed in detail below. As used in the present application, the term "transparent" refers not only to portions of the panels that allow the passage of light without appreciable scattering (so that objects are clearly viewable therethrough), but also to portions of the panels that both transmit light and diffuse the light so that objects may not be clearly viewable (often referred to as "translucent").

As previously noted, backlit display assembly 10 allows for various elements of a displayed image to change color, or shades thereof, over time. This is accomplished by passing light from light source 12, which can be changed to different colors of the visible light spectrum, through both outer and inner panels 14 and 16, which are in close registration to each other. In the embodiment shown in FIGS. 1 through 3, outer panel 14 includes as front image 19 printed thereon, preferably in color, that is visible to an observer 30 regardless of whether or not light from light source 12 is being passed through the panels. A rear image 17, or masking image, is formed on inner panel 16 and is either in color, black, or both, and serves two purposes. The first purpose is to control how much back lighting from light source 12 is permitted to pass through front image 19 formed on outer panel 14. Inner panel 16 may have opaque portions 25 (masking portions) and/or shaded portions (not shown) that prevent all light, or inhibits some light, respectively, from passing through the selected portions of front image 19. For example, opaque masking portions 25 on inner panel 16 result in the color of the corresponding portion 13 of outer panel 14 to remain the same to the observer regardless of the color of the light emitted by light source 12. As well, transparent portions, such as 22, for allowing all light to pass, or only partial light (muted) to pass, may be present. The second purpose is to control the color of light passing through front image 19 printed on outer panel 14, thereby controlling the hue of the various portions of the image that the observer sees.

Figure 4:
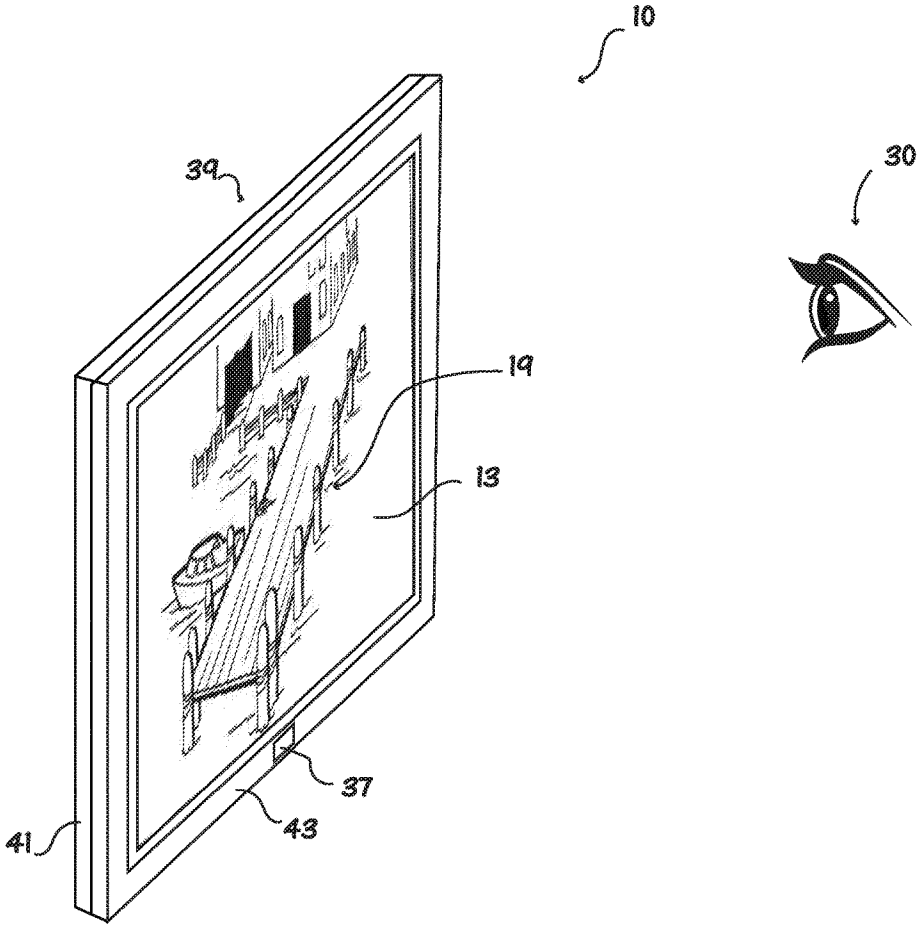
FIGS. 4 and 5 are a perspective and exploded view of the backlit display assembly shown in FIG. 1, with an alternate image being displayed.
Figure 5:
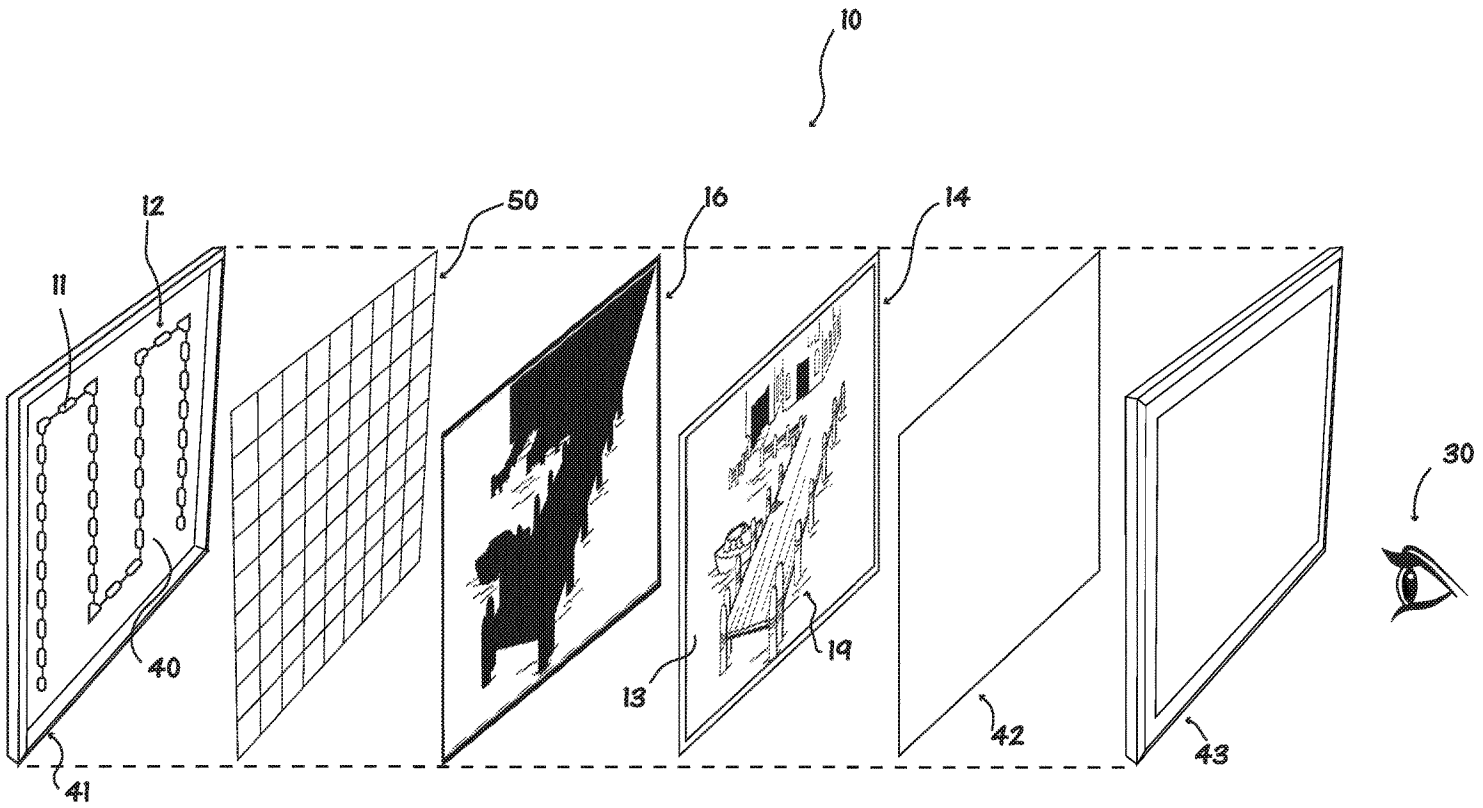

In the preferred embodiment shown, printed images are generally broken down into three different colors, those being cyan (C), magenta (M), yellow (Y), and black (K) (CMYK). For the purpose of this application, black is not considered a color. Preferably light source 12 is a plurality of light emitting diodes (LEDs) that can be broken down into three different colors: red (R), green (G) and blue (B) (RGB), and white, or clear, light. As shown in FIG. 2, the LEDs 11 of light source 12 extend along the outer perimeter of inner panel 16, on its back side. As such, the individual LEDs 11 are preferably disposed within frame 39 and, therefore, do not form "bright spots" within the field of the displayed image. In alternate embodiments, a diffuser sheet 50 may be utilized. For example, the embodiment of backlit display assembly 10 shown in FIGS. 4 and 5 differs primarily from the first embodiment (FIGS. 1-3) in that a diffuser sheet 50 is disposed between light source 12 and outer and inner panels 14 and 16. The use of diffuser sheet 50 allows LEDs 11 of light source 12 to be within the field of the displayed image, i.e., directly behind the front image 19, without forming visible bright spots. This is possible in that diffuser sheet 50 causes the light from the LEDs to be dispersed evenly within the diffuser sheet. As such, diffuser sheet 50 forms a more uniform, sheet-like light source than is possible with single points of light from individual LEDs 11. An example diffuser sheet is constructed from materials such as, but not limited to polycarbonate. One such film is available from 3M® under production number 3635-70.

At present, printing in the CMYK color scheme is a cost effective method to produce a colored picture. However, current technology exists to where color printers and ink manufacturers offer more ink colors than just the basic four CMYK colors. Printers that use six or more ink colors, including light cyan, light magenta, etc., in addition to the CMYK colors, are fairly common. These printers provide a larger range of colors than traditional four color printing. Note, although the presently discussed embodiment of display assembly 10 includes images printed while utilizing the CMYK color spectrum, in alternate embodiments the images can be printed with the above noted printers that utilize additional colors. Preferably, front image 19 and rear image 17 are printed on emulsified polyester print film, which is available from Blue River Digital Inc., and an example printer is Model No. HP Latex 3500, available from HP Inc. Note, although transparent/translucent films are preferably used for outer and inner panels 14 and 16, alternate print media may be used in alternate embodiments. For example, in alternate embodiments, outer panel 14 may be formed by a translucent woven canvas material formed with cotton, polyester, blends thereof, etc. Utilizing a woven canvas outer panel 14 as the print media gives the displayed image a textured appearance, which can be desirable as many paintings are typically created on textured canvas. Alternate print media may also include plastic sheeting, paper, fabric, etc.

Similarly to the preferred three color printing, although RGB LEDs 11 may be the most cost effective means of producing different colored lighting at present, dedicated color diodes can be added in combination with the RGB and white diodes in order to offer an even larger range of visible light colors. Note also, although LEDs are preferred for light source 12, other sources of colored light, such as, but not limited to incandescent bulbs, fluorescent bulbs, etc., may be used in alternate embodiments of the disclosed display assembly.

Referring now to FIG. 2, an example of how display assembly 10 is used to alter the color of a given element of an image is discussed. A specific element of printed front image 19 on outer panel 14 (e.g. a gas tank 20 of a motorcycle) is comprised of different amounts of the CYMK colors, as is known in the art. In order to change the color of gas tank 20 all the cyan, yellow, and magenta is removed from gas tank 20 on the front image, which results in a gray scale image (shades of black). However, showing a gray scale gas tank 20 for front image 19 on outer panel 14 may not be desirable when no backlighting from light source 12 is being provided, especially if the remainder of the image is in color. As such, the shades of black can be replaced with another color, for example blue. Gas tank 20 is now a blue scale image instead of a gray scale image. As such, when no light is provided by light source 12, gas tank 20 will appear blue to an observer 30. Shining different colors of light through gas tank 20 that differ from blue light now causes the color of gas tank 20 to be altered.

So that the color of gas tank 20 of front image 19 may be altered, a transparent portion (or translucent portion) 22 of rear image 17 that corresponds to gas tank 20 on front image 19 is provided on inner panel 16. Transparent portion 22 may be left clear, or it can be tinted with any desired color, such as, but not limited to blue, green, red, yellow, etc. The color of gas tank 20 that is observed by viewer 30 is dependent upon the initial color of gas tank 20 on outer panel 14, the color of transparent portion 22 of inner panel 16, and the color of the LED from light source 12 that is used to pass light through both outer and inner panels 14 and 16. For example, if transparent portion 22 of rear image is tinted yellow, passing white light through both gas tank 20 and transparent portion 22 will result in the gas tank being green. Other transparent portions, such as 21 and 23 can be provided for other components of front image 19, such as the tires 33 and 34. Note, the colors used for tires 33 and 34 may be the same, or differently colored, than gas tank 20. For example, whereas gas tank 20 is a blue scale image, tire 33 may be a red scale image and tire 34 may be a yellow scale image. As well, the colors of transparent portions 21 and 23 may be the same, or different (red, yellow, green, blue, etc.) than transparent portion 22 that corresponds to gas tank 20. In short, the color of each desired component or area on front image 19 is determined by factors that can differ from all the other components.

Figure 3:
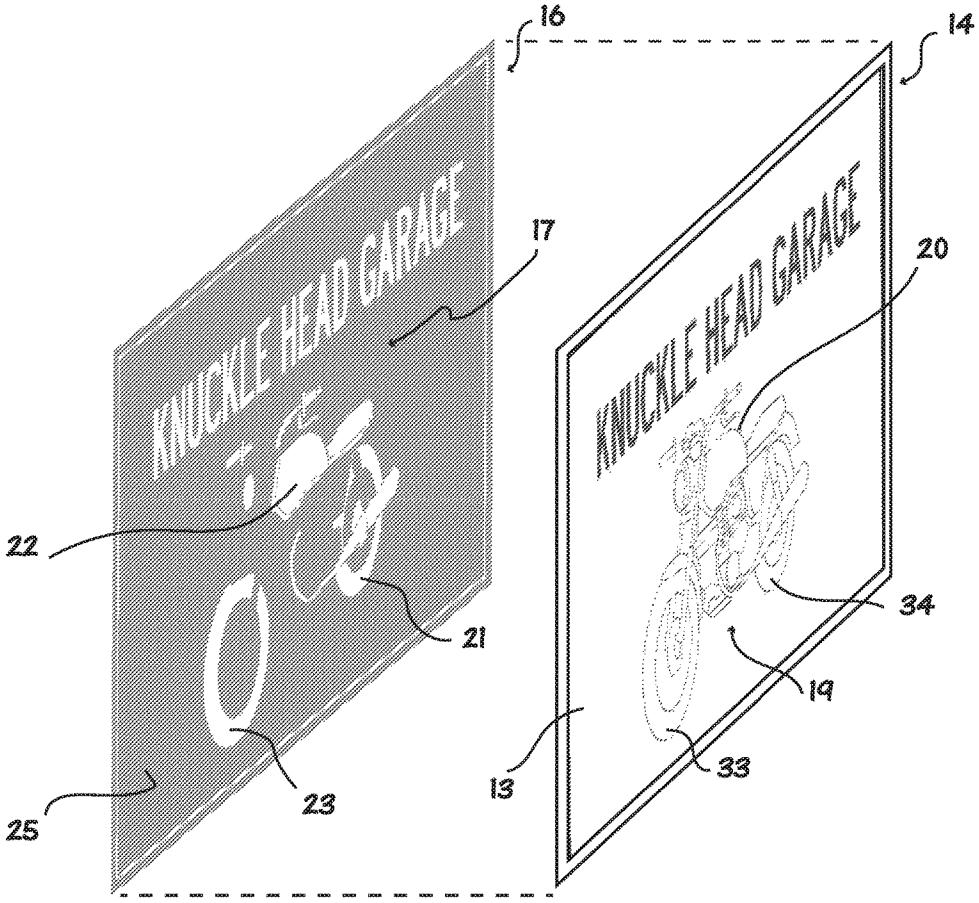
FIG. 3 is an exploded view of the outer panel and the inner panel of the backlit art display assembly shown in FIG. 1.

In addition to selectively altering the colors of various portions of front image 19, other portions of outer panel 14 in FIG. 3 may remain the same color regardless of the color light emitted by light source 12. For example, a portion 13 of outer panel 14 that surrounds front image 19 may be printed in purple. Use of opaque masking portion 25 on inner panel 16 that corresponds to the surrounding portion 13 of front panel insures that portion 13 remains purple regardless of the color of emitted light. So, as the colors of gas tank 20 and wheels 33 and 34 are varied by alternating the color of light emitted from light source 12, the colors of those components will do so against a surrounding portion 13 that is continuously purple in color.

Numerous different colors may be printed onto outer and inner backlit panels 14 and 16 with a four or more color printer. Preferably, the images and designs printed on the transparent and/or translucent print media are produced by: (i) creating a giclee print produced by transferring ink from available inkjet printing technology (either dye-based inks or pigmented inks); (2) using laser printer technology in which toner (ink powder) is melted onto the print media with a laser; or (3) using dye-sublimation printing technology in which heat is used to transfer dye onto the print media. As well, the number of shades of colors that can be created from modulating a red, green, and blue light source therethrough is extensive when combined with the colors disposed on the films. The attached chart, at FIG. 10, offers some specific examples of how the colors the observer sees can be controlled with display assembly 10.

The presentation of these color changes to an observer can be carefully controlled. If the color changes are too slow, observer 30 may not realize any change has occurred if the period of viewing is too short. If the color changes are too fast, the observer may become uneasy as very quick color changes can have a strobe light effect. Preferably, display assembly 10 includes an integrated chip (IC) 31 (FIG. 2) that allows the speed of the LED light changes from one color to another to be modulated. The IC can be pre-programmed to automatically pass through all the different colors that can be made with RGB light. The IC can also be pre-programmed to rotate through all the different colors, but cause certain light colors to be emitted for longer periods of time when those light colors that have a greater interaction with the colors printed on the films. The IC can also be pre-programmed to emit only one color light without any color variation (e.g. a constant blue light). The IC can also be pre-programmed to flash (e.g. a flashing sign can be more attention grabbing than a sign that is either constantly off or on). To further increase the number of colors that can be presented to the observer with the RGB and white colors of light from light source, in alternate embodiments the display of the individual colors of light can be caused to overlap so as to produce another color of light. For example, rather than emitting red light from light source 12 for a first period, and then emitting yellow light for second distinct period, the first and second periods of light emission from the two sources can be caused to overlap, resulting in the emission of orange light for a period of time. Similarly, after the first period of emitting red light is over, and before the second period of emitting yellow light is over, a third period of emitting blue light can occur which results in the emission of green light.

Preferably, an infrared, radio controlled, or bluetooth receiver 35 (seen in FIG. 2) is incorporated into display assembly 10, which will allow an observer to control the RGB and white LEDs of light source 12 (e.g. speed of the color change, what color of light to emit, turning the unit on and off) via a hand held remote device. In the event the display assembly is battery powered, minimization of electrical usage can be very important. As such, an optional motion sensor 37 (FIG. 4) can be placed on the unit, which upon sensing movement, turns the unit on and performs the color light changes as pre-programmed into the IC 31.

At present, the use of two backlit panels (outer panel 14 and inner panel 16) in close registration to each other is preferred in that it is a cost effective means of producing the enhanced viewing of the displayed image. However, the same effect may also be achieved by using a single panel. More specifically, by utilizing just outer panel 14, rather than printing the light inhibiting (masking) rear image 17 on a separate panel, the image can be inverted (i.e., the image is flipped horizontally) and printed on the back side of outer panel 14. As well, rear image 17 may be printed directly on the front surface of outer panel 14, with front image 19 being printed directly thereon. In alternate embodiments, more than two pieces of film may be used to create the desired image viewed by the observer, as discussed in greater detail below.

Figure 6:
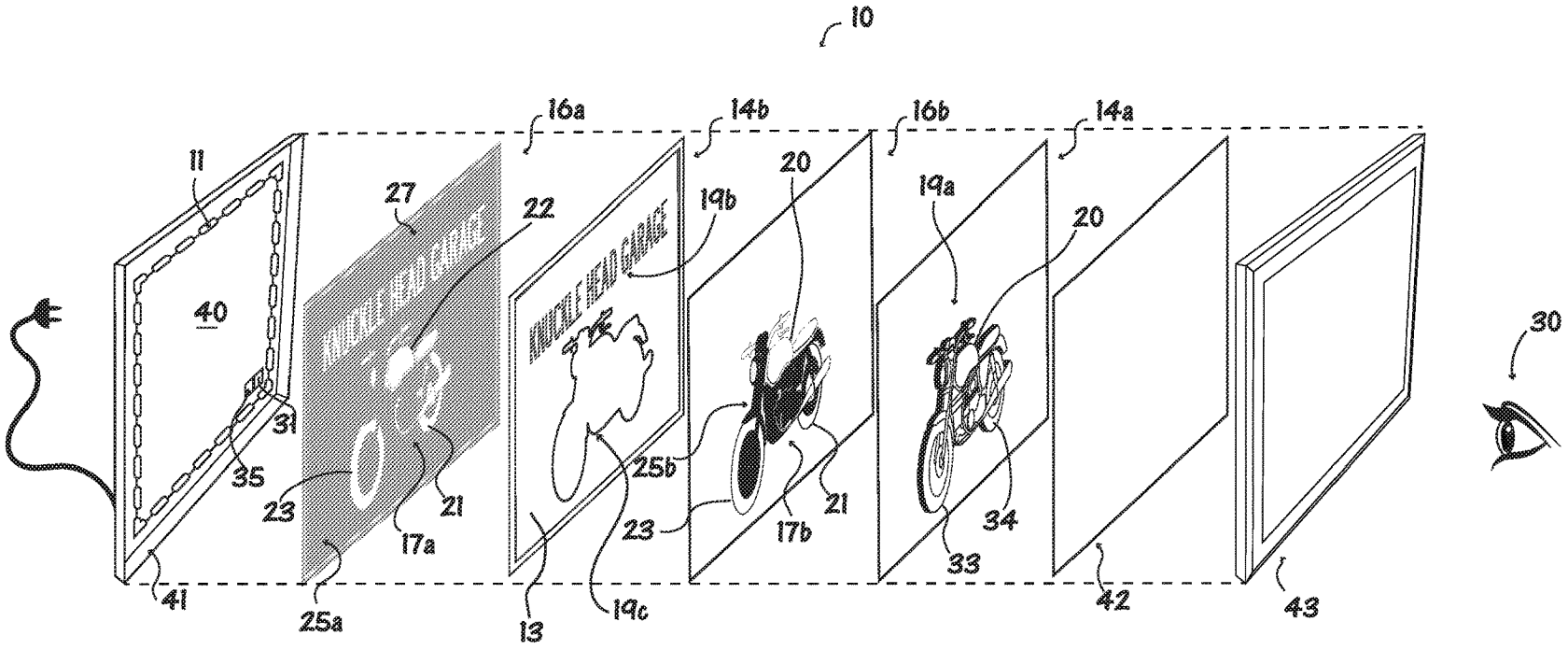
FIG. 6 is an exploded, perspective view of an alternate embodiment of a backlit art assembly in accordance with the present disclosure.

Referring now to FIG. 6, an alternate embodiment of a backlit display assembly 10 in accordance with the present disclosure is shown. Display assembly 10 differs primarily from the display assembly shown in FIGS. 1 through 3 in that a first intermediate panel **14*b* and a second intermediate panel 16*b* are disposed between outer panel 14*a* and inner panel 16*a*. Unlike the previously discussed embodiment in which the entire front image 19, both the motorcycle and the verbiage, are printed on the outer panel, in the present embodiment a first portion 19***a* (motorcycle) and a second portion 19*b* (verbiage) of front image 19 are printed on outer panel 14*a* and first intermediate panel 14*b*, respectively, to create a 3-D effect, as discussed in greater detail below. Additionally, whereas inner panel 16*a* includes a rear image 17*a*, or masking image, and opaque portion 25*a* similar to that found in the first embodiment, an optional secondary rear image 17*b* is provided on second intermediate panel 16*b*. Similarly to rear image 17*a*, secondary rear image 17*b* may include transparent portions 21, 22, 23, etc. and opaque masking portions 25*b*.

Unlike the previously discussed embodiment in which outer and inner panels 14 and 16 (FIG. 2) are in contact with each other along the extent of their adjacent surfaces, outer panel 14*a* and inner panel 16*a* of the present embodiment are spaced apart from each other in a parallel fashion such that a gap of approximately 2.0-5.0 millimeters (mm) is formed therebetween. Note, the gap between outer panel 14*a* and inner panel 16*a* may be adjusted as desired to achieve the desired 3-D effect. Inner panel 16*a* is preferably in contact with first intermediate panel 14*b* along their adjacent surfaces such that a transparent portion 27 (verbiage) of inner panel 16*a* corresponds with the second portion 19*b* (verbiage) of front image that is formed on first intermediate panel 14*b*. As previously discussed with respect to the first embodiment, the transparent portions 27 and 19*b* may be colored as desired. Similarly, second intermediate panel 16*b* and outer panel 14*a* are preferably in contact with each other along their adjacent surfaces so that secondary rear image 17*b* is aligned with first portion 19*a* (motorcycle) of the front image. As in the previously discussed example, front image 19*a* includes transparent portions corresponding to gas tank 20 and tires 33 and 34. Similarly, both rear image 17*a* and secondary rear image 17*b* include transparent portions 22, 23 and 21 that correspond to similar portions of the front image on both outer panel 14*a* and first intermediate panel 14*b*.

Note also, a colored surround portion 13 similar to that described in the first example can be provided on any of outer panel 14*a*, first interior panel 14*b* or second interior panel 16*b*. Preferably, as shown, surround portion 13 is disposed on first interior panel 14*b* so that the image of the motorcycle 19 will have the 3-D effect discussed below with regard to the surround portion 13. Note, if surround portion 13 is provided on either of outer panel 14*a* or second interior panel 16*b*, the first portion 19*a* (motorcycle) will appear to be in the same plane as the surround portion. Preferably, when surround portion 13 is provided on first interior panel 14*b*, a see-through portion 19*c* that corresponds to the outline of the front image's first portion 19*a* is provided on first interior panel 14*b* so as not to interfere with the coloration of first portion 19*a*. Note, if surround portion 13 is provided on either of outer panel 14*a* or second interior panel 16*b*, a see-through portion (not shown) that corresponds to the outline of the front image's second portion 19*b* is similarly provided on that panel.

As noted above, the present embodiment operates in substantially the same manner as the embodiment shown in FIGS. 1 through 3, with the exception that first portion 19*a* (motorcycle) of the front image is disposed on outer panel 14*a* whereas second portion 19*b* (verbiage) of the front image is disposed on first intermediate panel 14*b* and, therefore, spaced therefrom. The gap formed in the horizontal direction between the first and second portions 19*a* and 19*b* of the front image provide a 3-D effect to the observer in that first portion 19*a*, in this case the motorcycle, appears to be closer to the observer than does both second portion 19*b*, the verbiage, and surround portion 13. As previously noted, secondary rear image 17*b* and, therefore, second interior panel 16*b*, is optional. The purpose of secondary rear image 17*b*, which includes opaque masking portions 25*b* (shown in black), is to prevent a halo effect due to the diffusion of light in all directions as a result of the spacing between outer panel 14*a* and inner panel 16*a*. Note, without secondary rear image 17*b* of the optional secondary intermediate panel 16*b*, there may be a slight halo effect due to the scattering of light over the gap between the panels.

Figure 7B:
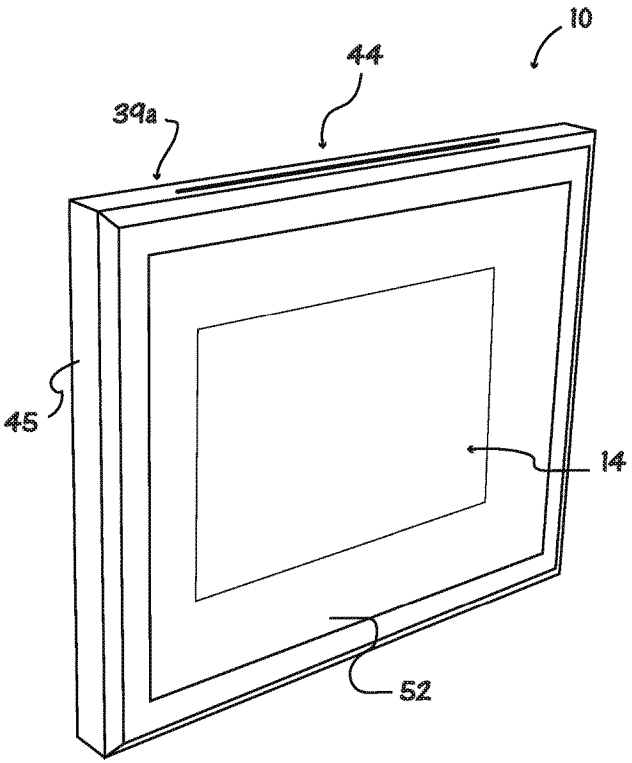
FIGS. 7A and 7B are perspective views of an alternate embodiment of a backlit display assembly in accordance with the present disclosure.
Figure 7A:
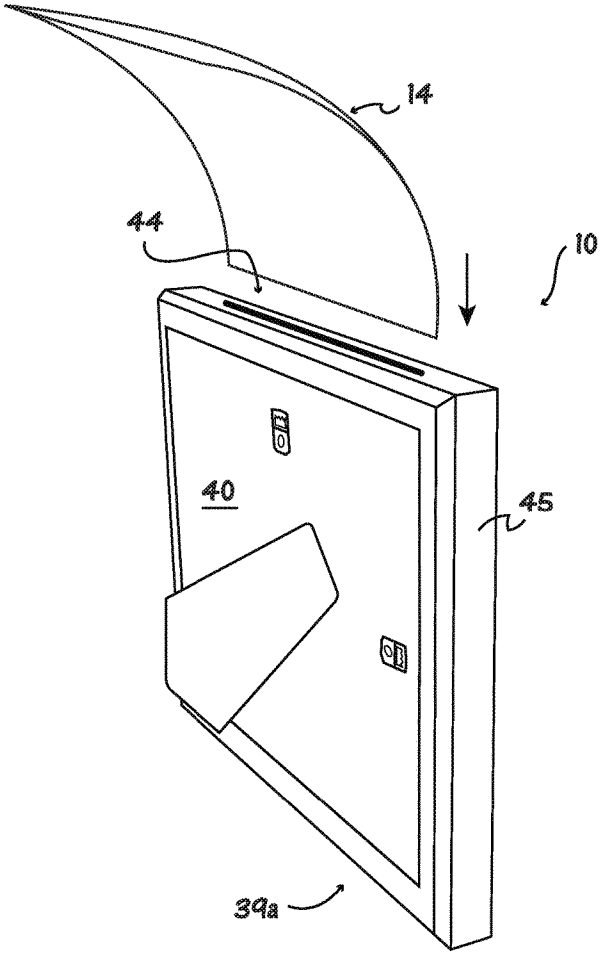

Referring now to FIGS. 7A and 7B, an alternate embodiment of a backlit display assembly 10 is shown in which frame 39*a* of the display assembly is formed by a single portion, rather than by front and rear frame portions 43 and 41 as in the first embodiment (FIGS. 1-3). Additionally, as shown, rear panel 40 need not be removable from frame 39*a* to allow different images to be displayed on backlit panel 14. As shown, a slot 44 is provided in the outer peripheral surface 45 of frame 39*a*. Slot 44 allows for the previously described backlit panels 14 to be slid and removed from frame 39 without disassembling multiple components thereof. As shown, slot 44 is aligned with a space between an opaque mat 52 and a light assembly (not shown) as was previously discussed. Slot 44 allows for the displayed images to be rapidly and easily exchanged.

Figure 8:
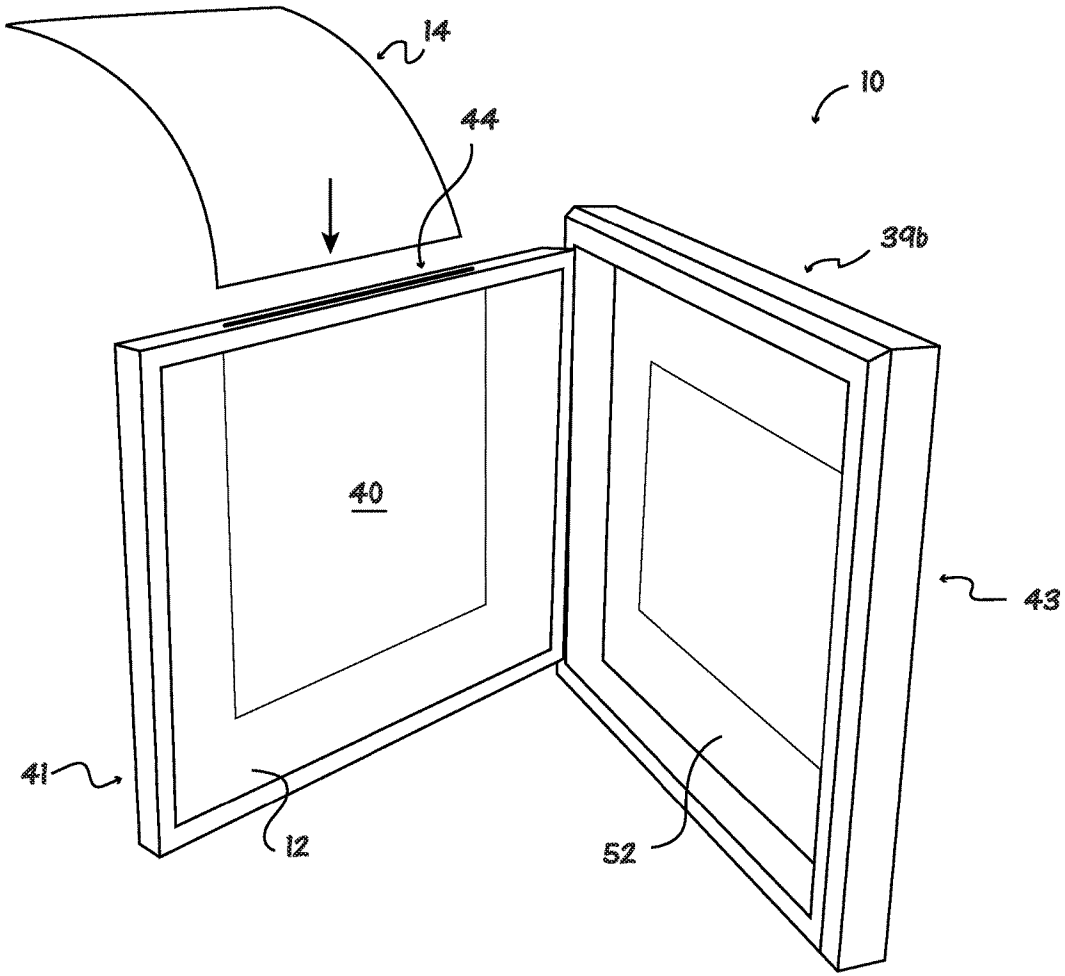
FIG. 8 is a perspective view of an alternate embodiment of a backlit display assembly in accordance with present disclosure.

Referring now to FIG. 8, an alternate embodiment of backlit display assembly 10 includes a frame 39*b* that is formed by front and rear frame portions 43 and 41 that are pivotably connected, such as by a hinge. Similar to the embodiment shown in FIGS. 7A and 7B, display assembly 10 includes an opaque mat 52 that is disposed in front frame portion 43 so that it prevents an observer from directly observing light source 12 which is disposed in rear frame portion 41. Although not necessary because front and rear frame portions 43 and 41 are separable, a slot 44 may be provided in a peripheral outer surface of either frame portion to allow display panels 14 to be readily changed when desired.

Figure 9:
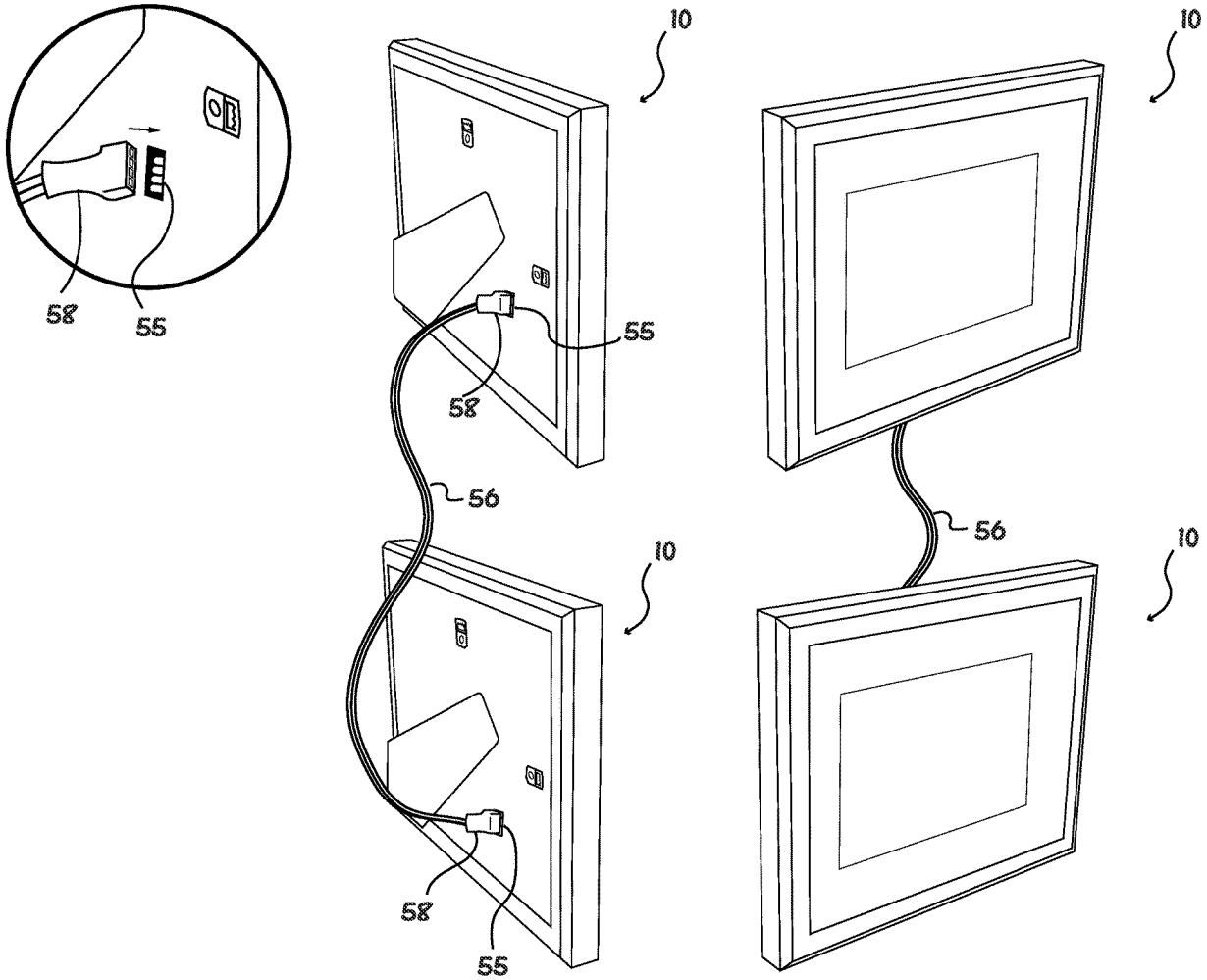
FIG. 9 shows perspective views of backlit art displays as shown in FIG. 1 that are electrically connected.

Referring now to FIG. 9, embodiments of display assembly 10 in accordance with the present disclosure may be electrically connected by jumper cables 56. As shown, each display assembly 10 includes a receptacle 55 for receiving a corresponding electrical connector 58 of a jumper cable 56. Note, more than one receptacle 55 may be provided on each display assembly 10 to allow for multiple display assemblies to be connected with multiple jumper cables 56. Jumper cables 56 allow a single backlit display assembly 10 to act as a master unit, whereas the remaining display assemblies are slave units, receiving both power and light source sequencing instructions from the master unit.

Figure 11A:
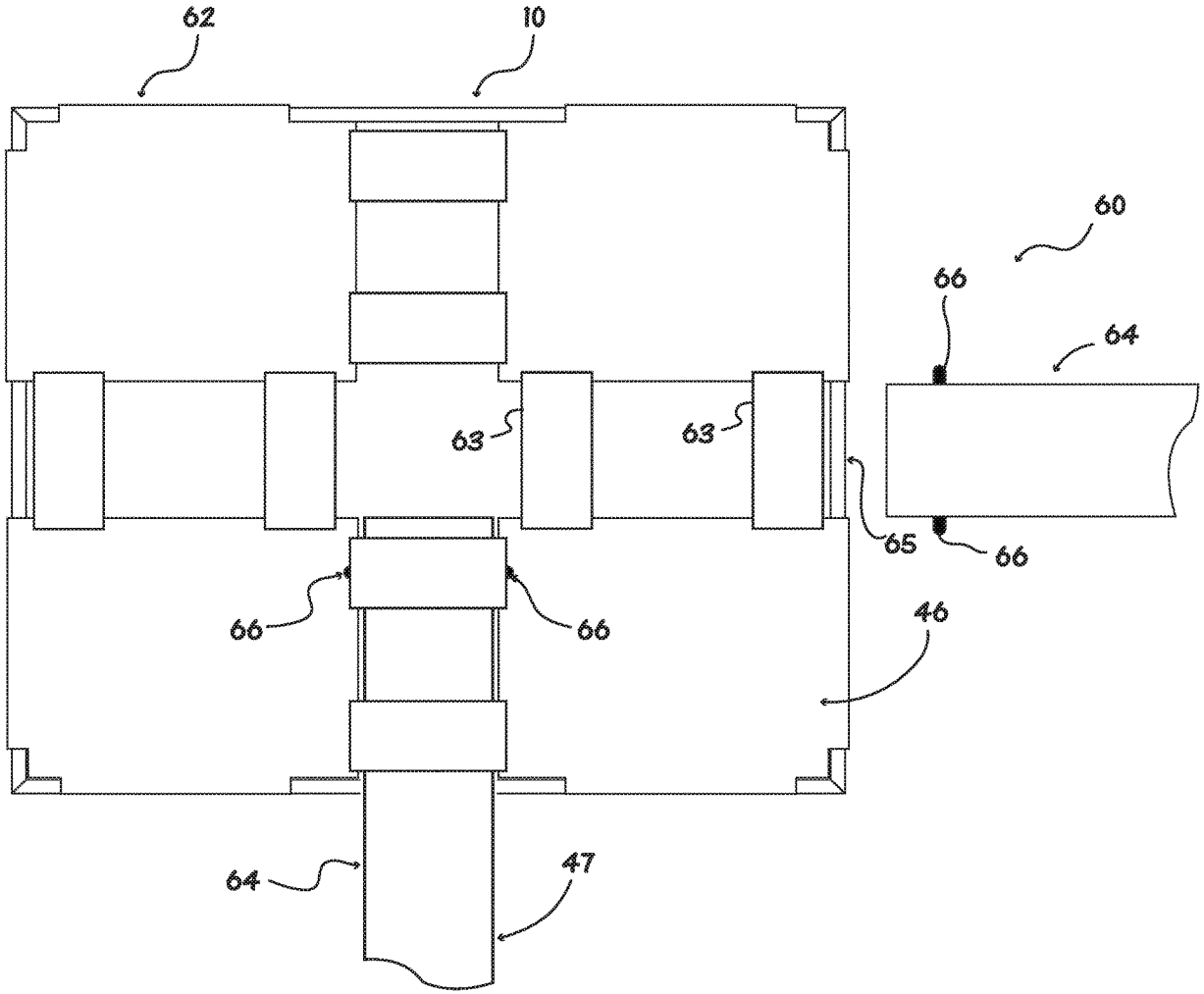
FIGS. 11A and 11B are plan views of a mounting assembly for use in connecting multiple backlit display assemblies in accordance with the present disclosure.
Figure 11B:
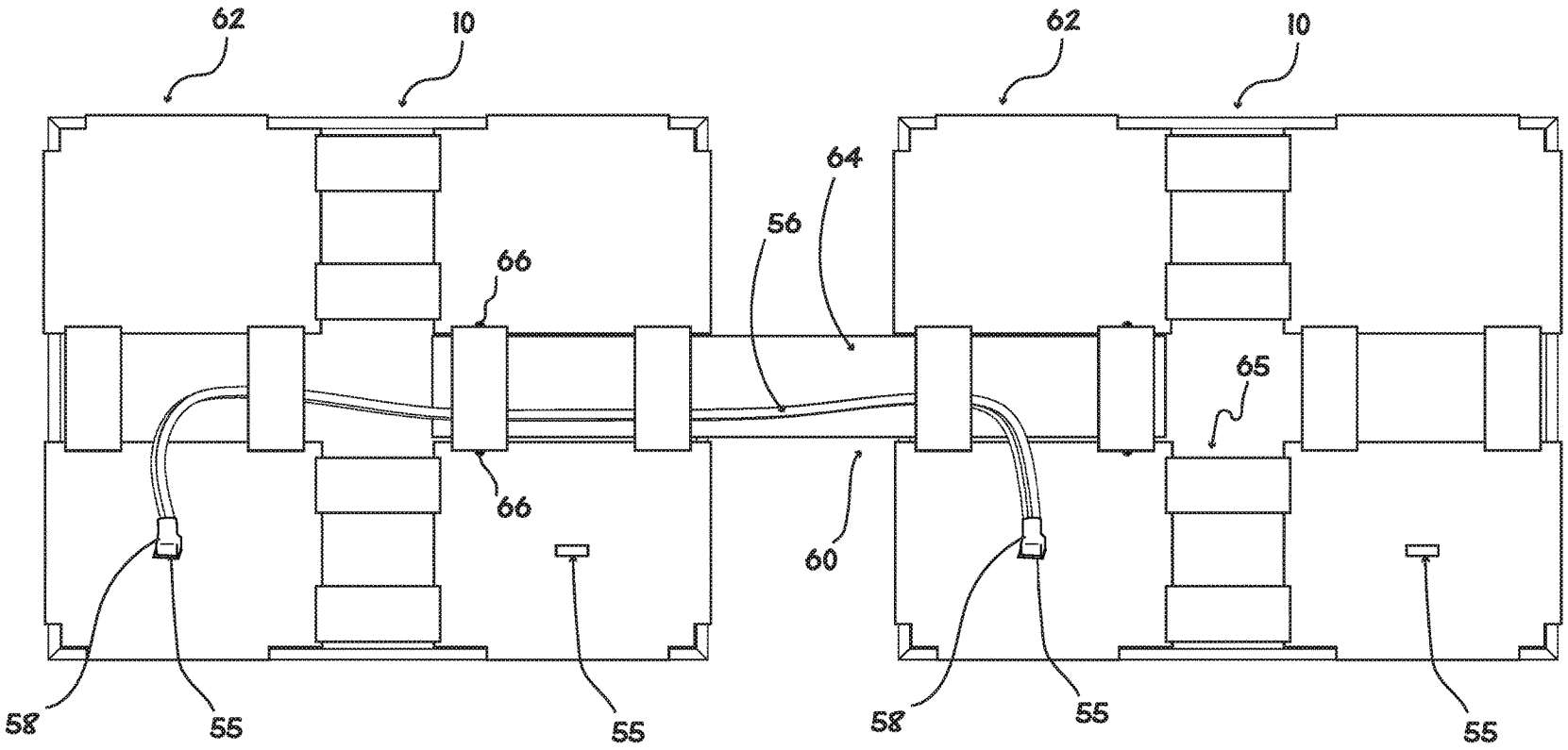

Referring now to FIGS. 11A and 11B, a mounting assembly 60 for hanging multiple backlit display assemblies 10 is shown. Preferably, mounting assembly 60 includes multiple frame holders 62 connected by one or more connection members 64. As shown, each frame holder 62 is configured to receive a releasable corresponding display assembly 10, such as in a snap-fit, or a frame holder 62 may be fastened to the corresponding display assembly by fasteners 10. Each frame holder 62 preferably includes bridge members 63 that define multiple recesses 65 for receiving a slidable corresponding end of a connection member 64. Each bridge member 63 is spaced from the back surface of the corresponding display assembly 10 by a distance that is approximately equal to the width of the corresponding connection member 64 in the horizontal direction that is transverse to a longitudinal center axis of the connection member. As such, each recess 65 has a cross-sectional area that is substantially equal to the cross-sectional area of the corresponding connection member 64 when taken in a plane that is transverse to the longitudinal center axis of the member. Therefore, each recess 65 is configured to receive the slidable end of a connection member 64 in a manner that allows for minimum movement between the two objects. As well, each recess includes a pair of recesses (not shown) that is configured to receive a pair of releasable detents 66 disposed on each end of connection member 64. As such, when connection member 64 is properly positioned within the corresponding recess 65, detent 66 will automatically engage with pair of recesses, thereby securing the releasable connection member therein. To release frame holder 62 from connection member 64, one simply depresses detent 66, which would preferably spring load, and pulls outwardly on a connection member until it was removed from the corresponding recess by sliding it out. Mounting assembly 60 allows multiple display assemblies 10 to be hung from the wall with only a single hanger and, therefore, single hole having to be made in the wall. As well, connection members 64 allows jumper cables 56 to be connected between the multiple display assemblies 10 without the cable being seen by an observer of the display units 10. In an alternate embodiment, each connection member 64 is partially hollow along its length to allow jumper cables 56 to be routed therethrough so they may be hidden from view.

Figure 12:
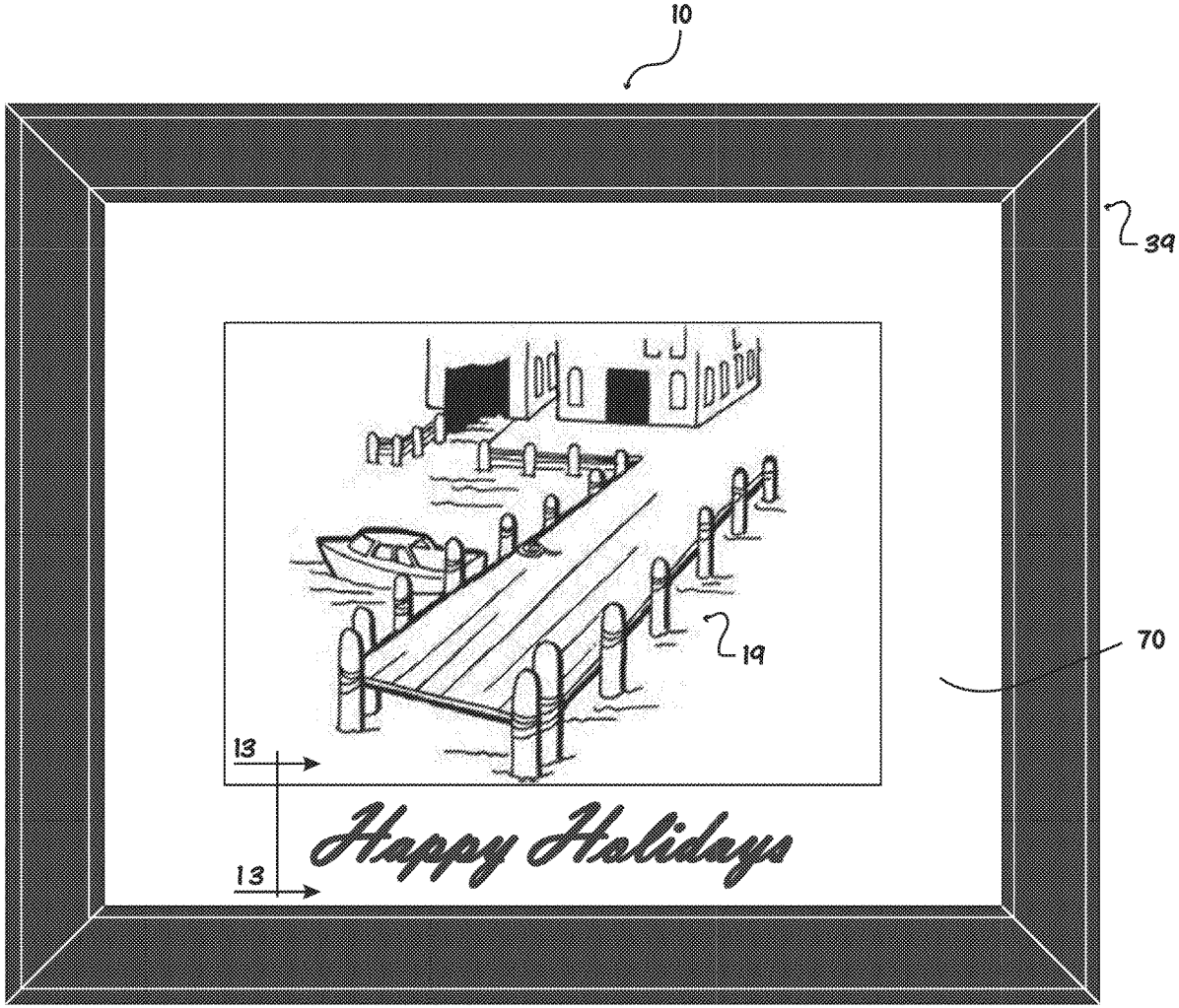
FIG. 12 is a front plan view of a backlit display assembly in accordance with the present disclosure, including a mat.
Figure 13B:
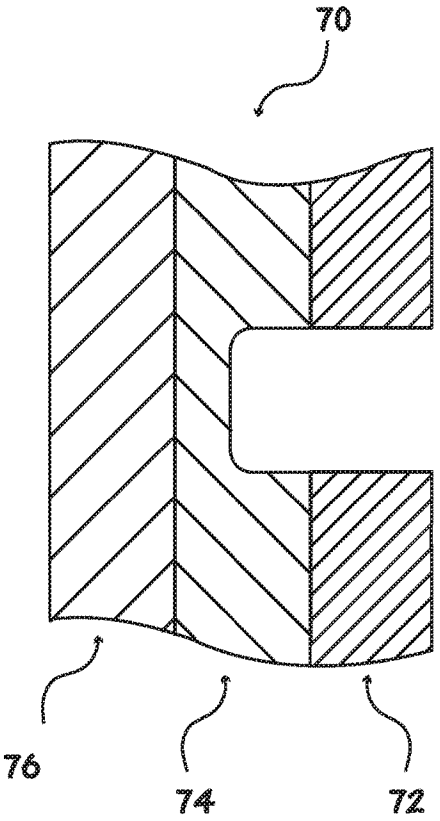
FIGS. 13A and 13B are partial, cross-sectional views of the mat of the backlit display assembly shown in FIG. 12, taken along line 13-13.
Figure 13A:
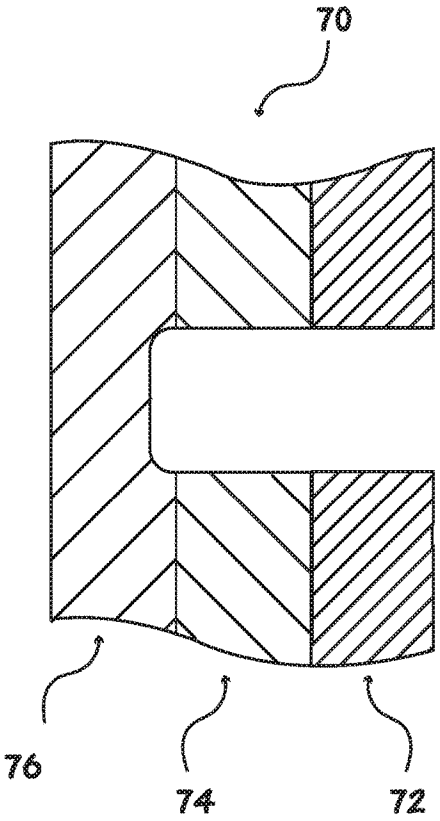

Referring now to FIGS. 12 and 13, in an alternate embodiment of a backlit display assembly 10, a multi-layered mat 70 is used that allows engraving to be performed thereon that results in multiple coloring displayed by the mat. For example, in a preferred embodiment, mat 70 may include a blue outer layer 72, a red middle layer 74 and white inner layer 76 that are secured together in a laminar fashion. The various layers of mat may be constructed of materials such as, but not limited to, paper, plastic films, cardboard, etc. Once the mat is created using the desired number of layers and/or colors, the mat may be engraved to various depths with a design such that the engraving reaches the desired level and, therefore, color of the mat. For example, as shown in FIG. 13, the word "Happy" may be engraved in a manner that exposes white inner layer 76 as shown in FIG. 13A, whereas the word "Holidays" is engraved to a depth that exposes only red middle layer 74 as shown in FIG. 13B. As such, when viewing the display an observer will see a blue mat 70 with the phrase "Happy Holidays" engraved thereon in which "Happy" is in white and "Holidays" is in red. Note, wherein the design is provided in which its edges are beveled, an observer may see multiple colors of the various layers along the horizontal depth of the design sidewall.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed:

1. A display assembly, comprising:

a first backlit display, including a first panel including a first color image formed thereon, the first color image including a first transparent portion of a first color and a second transparent portion of a second color that differs from the first color of the first transparent portion of the first panel;

a second panel including a first transparent portion of a first color, the second panel being adjacent the first panel such that the first transparent portion of the first panel is aligned with the first transparent portion of the second panel; and a light source that emits at least a first color light and a second color light, wherein the first color of the first transparent portion of the first panel is a different color than the first color of the first transparent portion of the second panel, and light from the light source passes through the first transparent portions of both the first panel and the second panel.

2. The display assembly of claim 1, wherein the first color light of the first light source is a different color than the first color of the first transparent portion of the first panel and the first color of the first transparent portion of the second panel.

* * * * *